US009353999B2

(12) United States Patent
Dede

(10) Patent No.: US 9,353,999 B2
(45) Date of Patent: May 31, 2016

(54) COOLING APPARATUSES AND ELECTRONICS MODULES HAVING BRANCHING MICROCHANNELS

(75) Inventor: Ercan Mehmet Dede, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 672 days.

(21) Appl. No.: 13/561,117

(22) Filed: Jul. 30, 2012

(65) Prior Publication Data

US 2014/0029199 A1 Jan. 30, 2014

(51) Int. Cl.

| | |
|---|---|
| ***H05K 7/20*** | (2006.01) |
| ***F28F 9/02*** | (2006.01) |
| ***F28F 3/04*** | (2006.01) |
| ***F28F 3/12*** | (2006.01) |
| *G06F 1/20* | (2006.01) |
| *F28D 21/00* | (2006.01) |

(52) U.S. Cl.

CPC . *F28F 9/02* (2013.01); *F28F 3/048* (2013.01); *F28F 3/12* (2013.01); *F28D 2021/0028* (2013.01); *F28F 2210/02* (2013.01); *F28F 2250/04* (2013.01); *F28F 2260/02* (2013.01)

(58) Field of Classification Search

CPC ..... H05K 7/20; H05K 7/20927; F28F 9/02; H01L 23/4735; H01L 23/473; G06F 1/20

USPC ..... 361/679.46, 679.53, 679.54, 688, 689, 361/698, 699, 700–712, 175, 719; 165/80.2, 80.4, 80.5, 104.33, 104.34, 165/175; 174/15.1, 16.3; 257/706–727; 62/259.2, 310

See application file for complete search history.

(56) References Cited

U.S. PATENT DOCUMENTS

| | | | | | |
|---|---|---|---|---|---|
| 3,361,195 | A * | 1/1968 | Motto, Jr. et al. | ..... | 165/80.4 |
| 4,748,495 | A * | 5/1988 | Kucharek | ..... | 257/713 |
| 5,016,090 | A * | 5/1991 | Galyon et al. | ..... | 257/714 |
| 5,168,348 | A * | 12/1992 | Chu et al. | ..... | 257/713 |
| 5,220,804 | A * | 6/1993 | Tilton et al. | ..... | 62/64 |
| 5,269,372 | A * | 12/1993 | Chu et al. | ..... | 165/80.4 |
| 5,388,635 | A * | 2/1995 | Gruber et al. | ..... | 165/80.4 |
| 6,986,382 | B2 | 1/2006 | Upadhya et al. | | |
| 7,035,104 | B2 * | 4/2006 | Meyer | ..... | 361/700 |
| 7,104,312 | B2 * | 9/2006 | Goodson et al. | ..... | 165/80.4 |
| 7,190,580 | B2 * | 3/2007 | Bezama et al. | ..... | 361/699 |
| 7,255,153 | B2 * | 8/2007 | Berger et al. | ..... | 165/80.4 |
| 7,277,283 | B2 | 10/2007 | Campbell et al. | | |
| 7,331,378 | B2 | 2/2008 | Bhatti et al. | | |

(Continued)

*Primary Examiner* — Michail V Datskovskiy

(74) *Attorney, Agent, or Firm* — Dinsmore & Shohl LLP

(57) ABSTRACT

Electronics modules and cooling apparatuses having branching microchannels for liquid cooling by jet impingement and fluid flow are disclosed. In one embodiment, a cooling apparatus includes a heat receiving surface and an array of branching microchannel cells. Each branching microchannel cell includes an inlet manifold fluidly coupled to the heat receiving surface and a branching microchannel manifold fluidly coupled to the inlet manifold. The branching microchannel manifold includes a plurality of fins that orthogonally extend from the heat receiving surface such that the plurality of fins define a plurality of branching microchannels that is normal with respect to the heat receiving surface. The cooling apparatus further includes an outlet manifold fluidly coupled to the plurality of branching microchannels. The coolant fluid flows through the plurality of branching microchannels in a direction normal to the heat receiving surface.

17 Claims, 9 Drawing Sheets

(56) References Cited

U.S. PATENT DOCUMENTS

| | | | | |
|---|---|---|---|---|
| 7,375,962 | B2 | 5/2008 | Campbell et al. | |
| 7,516,776 | B2 * | 4/2009 | Bezama et al. | 165/80.4 |
| 7,536,870 | B2 * | 5/2009 | Bezama et al. | 62/310 |
| 7,562,444 | B2 * | 7/2009 | Vetter | 29/832 |
| 7,578,337 | B2 * | 8/2009 | Spokoiny et al. | 165/80.4 |
| 7,597,135 | B2 * | 10/2009 | Ghosh et al. | 165/80.4 |
| 7,717,070 | B2 | 5/2010 | Kanig et al. | |
| 7,762,314 | B2 * | 7/2010 | Campbell et al. | 165/80.3 |
| 7,802,442 | B2 * | 9/2010 | Bezama et al. | 62/259.2 |
| 7,992,627 | B2 * | 8/2011 | Bezama et al. | 165/80.4 |
| 8,077,460 | B1 | 12/2011 | Dede et al. | |
| 8,199,505 | B2 * | 6/2012 | Dede | 361/702 |
| 8,210,243 | B2 * | 7/2012 | Bezama et al. | 165/80.4 |
| 8,427,832 | B2 * | 4/2013 | Dede et al. | 361/702 |
| 2007/0119565 | A1 | 5/2007 | Brunschwiler et al. | |
| 2007/0221364 | A1 * | 9/2007 | Lai et al. | 165/80.4 |
| 2007/0272392 | A1 * | 11/2007 | Ghosh et al. | 165/80.4 |
| 2009/0090490 | A1 * | 4/2009 | Yoshida et al. | 165/104.33 |
| 2009/0294106 | A1 * | 12/2009 | Flotta et al. | 165/104.33 |
| 2012/0063091 | A1 | 3/2012 | Dede et al. | |
| 2012/0285667 | A1 * | 11/2012 | Maxik et al. | 165/121 |

* cited by examiner

COOLING APPARATUSES AND ELECTRONICS MODULES HAVING BRANCHING MICROCHANNELS

TECHNICAL FIELD

The present specification generally relates to cooling apparatuses and, more particular, cooling apparatuses and electronics modules having an array of branching microchannel cells for liquid cooling a heat generating device.

BACKGROUND

Heat transfer devices may be coupled to a heat generating device, such as a power electronics device, to remove heat and lower the maximum operating temperature of the heat generating device. Cooling fluid may be used in heat transfer devices to receive heat generated by the heat generating device by convective thermal transfer, and remove such heat from the heat generating device. However, as power electronic devices are designed to operate at increased power levels and generate increased corresponding heat flux due to the demands of newly developed electrical systems, conventional heat sinks are unable to adequately remove the heat flux to effectively lower the operating temperature of the power electronics to acceptable temperature levels.

Accordingly, a need exists for alternative heat transfer devices having enhanced thermal energy transfer characteristics.

SUMMARY

In one embodiment, a cooling apparatus includes a heat receiving surface and an array of branching microchannel cells. Each branching microchannel cell includes an inlet manifold fluidly coupled to the heat receiving surface and a branching microchannel manifold fluidly coupled to the inlet manifold. The branching microchannel manifold includes a plurality of fins that orthogonally extend from the heat receiving surface such that the plurality of fins define a plurality of branching microchannels that is normal with respect to the heat receiving surface. The cooling apparatus further includes an outlet manifold fluidly coupled to the plurality of branching microchannels. The coolant fluid flows through the plurality of branching microchannels in a direction normal to the heat receiving surface.

In another embodiment, an electronics module includes a heat receiving surface, a semiconductor device thermally coupled to the heat receiving surface, an inlet manifold coupled to the heat receiving surface, and a branching microchannel manifold fluidly coupled to the inlet manifold. The branching microchannel manifold includes a plurality of fins that orthogonally extend from the heat receiving surface such that the plurality of fins define a plurality of branching microchannels that is normal with respect to the heat receiving surface. The electronics module further includes an outlet manifold fluidly coupled to the plurality of branching microchannels, wherein the coolant fluid flows through the plurality of branching microchannels in a direction normal to the heat receiving surface.

In yet another embodiment, a vehicle includes an electric motor and an electronics module electrically coupled to the electric motor. The electronics module includes a heat receiving surface, a semiconductor device thermally coupled to the heat receiving surface, an inlet manifold coupled to the heat receiving surface, and a branching microchannel manifold fluidly coupled to the inlet manifold. The branching microchannel manifold includes a plurality of fins that orthogonally extend from the heat receiving surface such that the plurality of fins define a plurality of branching microchannels that is normal with respect to the heat receiving surface. The vehicle further includes an outlet manifold fluidly coupled to the plurality of branching microchannels, wherein the coolant fluid flows through the plurality of branching microchannels in a direction normal to the heat receiving surface.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to electronics modules and cooling apparatuses having branching microchannels through which coolant fluid flows to remove heat flux from a heat generating device. Embodiments combine jet impingement of coolant fluid with fluid flow through branching microchannels in a jet/microchannel combination design. More particularly, the branching microchannels of the present disclosure have a non-uniform shape (i.e., the microchannels are not straight) and a high aspect ratio (microchannel height over width) that provides a tortuous fluid flow path. The branching microchannels have a hierarchical width that both reduces pressure drop within the cooling apparatus, and also increases the rate of heat transfer to the coolant fluid. Various embodiments of cooling apparatuses and power electronic modules are described in detail below.

Figure 1:
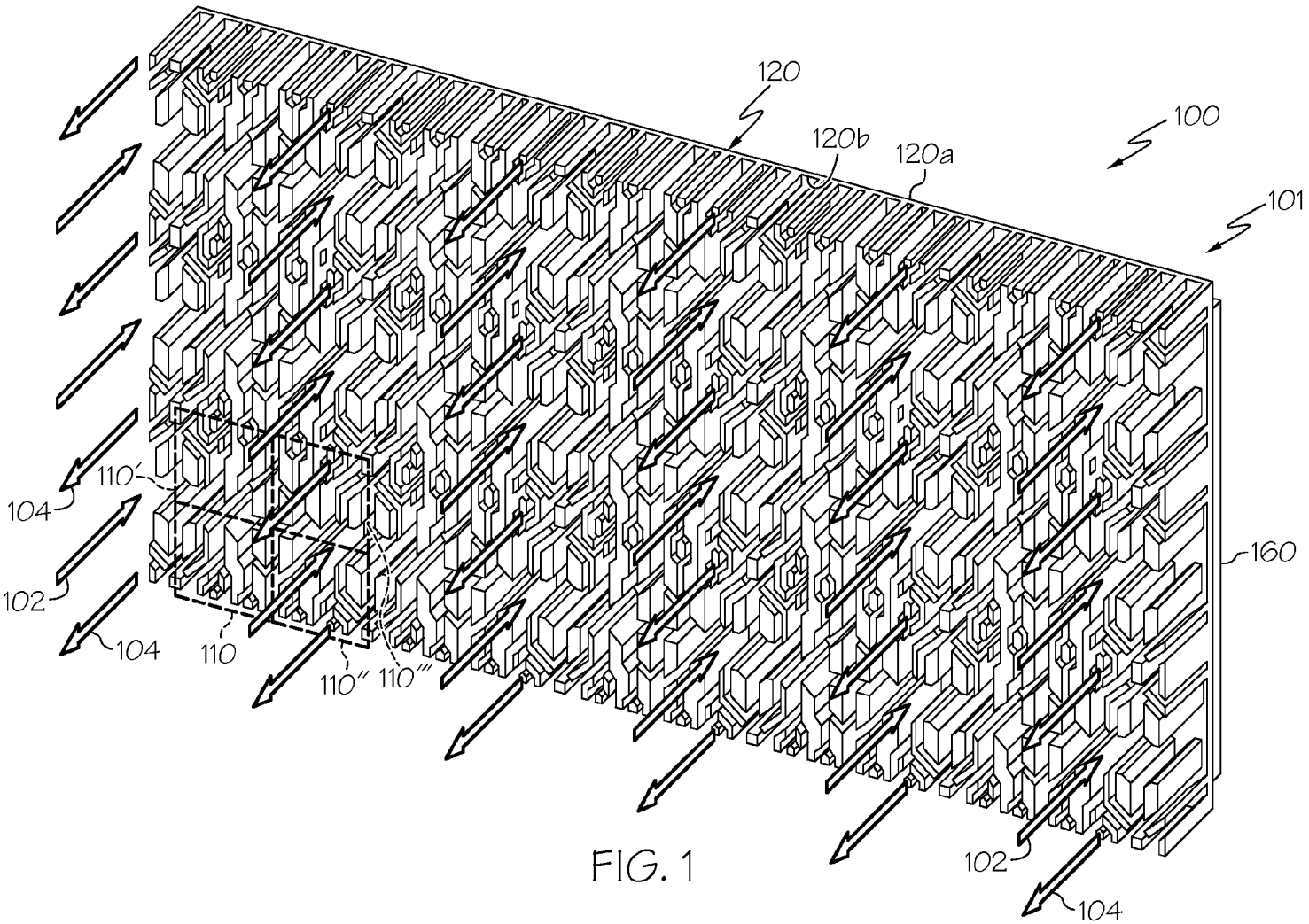
FIG. 1 schematically depicts a perspective view of an exemplary electronics module including an exemplary cooling apparatus having an array of branching microchannel cells, according to one or more embodiments described and illustrated herein.

Referring now to FIG. 1, an electronics module 100 comprising a cooling apparatus 101 defined by an array of branching microchannel cells 110. The cooling apparatus 101 includes a plate 120 including a heat receiving surface 120*a* and a heat radiating surface 120*b*. One or more heat generating devices 160 may be thermally coupled to the heat receiving surface 120*a*. In one embodiment, the heat generating devices 160 are configured as power semiconductor devices including, but not limited to, insulated gate bi-polar transistors (IGBTs), power metal oxide semiconductor field-effect transistors (MOSFETs), power diodes, and the like. As an example and not a limitation, the electronics module 100 may be incorporated into a larger electrical system, such as an inverter/converter circuit of an electrified vehicle (e.g., a hybrid vehicle, a plug-in hybrid vehicle, an electric vehicle, and the like).

The plate 120 may be made of a thermally conductive material, such as, but not limited to, aluminum, copper, and thermally conductive polymers. The branching microchannel cells 110 may be arranged on the heat radiating surface 120*b* of the plate 120 in a repeating pattern. The illustrated cooling apparatus 101 includes a symmetrical array of individual branching microchannel cells 110. It is noted that only four of the branching microchannel cells 110 are labeled and numbered in FIG. 1 for clarity of illustration. In the pattern of the branching microchannel cells 110 of the embodiment depicted in FIG. 1, branching microchannel cell 110' is configured as a vertically mirrored inverse of branching microchannel cell 110, while branching microchannel cell 110" is configured as a horizontally mirrored inverse of branching microchannel cell 110. Branching microchannel cell 110'" is configured as both horizontally and vertically mirrored inverse of branching microchannel cell 110. The quadrant defined by branching microchannel cells 110, 110', 110", and 110'" may be repeated across the array, depending on the number of desired branching microchannel cells.

Coolant fluid may be introduced into the branching microchannel cells 110 through coolant inlets as indicated by arrows 102, where it impinges the heat radiating surface 120*b*, flows into the branching microchannels, and flows out of coolant outlets as indicated by arrows 104. It is noted that the coolant inlets, the coolant outlets and the associated manifolds are not depicted in FIG. 1 for ease of illustration. It should be understood that embodiments are not limited to any number of individual branching microchannel cells 100. The number of microchannel cells 110 may depend on a variety of factors, such as the size of the semiconductor device, the amount of heat flux generated, etc.

Figure 2:
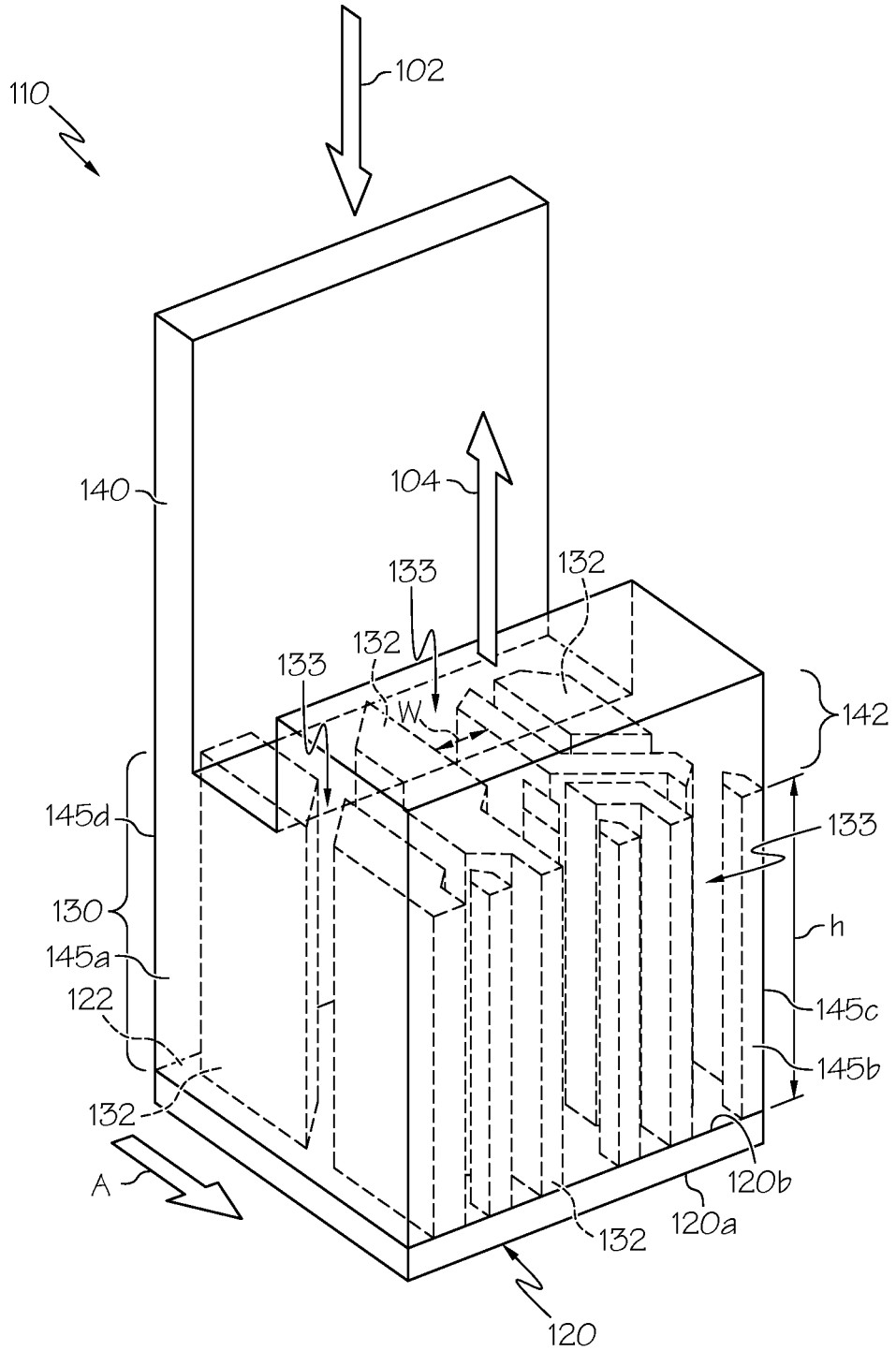
FIG. 2 schematically depicts a perspective view of an individual branching microchannel cell of the array of branching microchannel cells depicted in FIG. 1, according to one or more embodiments described and illustrated herein.

FIG. 2 depicts a branching microchannel cell 110 in greater detail. The branching microchannel cell 110 is a ¼sth symmetry model of the cooling apparatus 101 depicted in FIG. 1. The branching microchannel cell 110 includes an inlet manifold 140, a branching microchannel manifold 130, and an outlet manifold 142 that is fluidly coupled to the branching microchannel manifold 130. It is noted that schematic depiction of the branching microchannel cell 110 includes sidewalls 145*a*-145*d*; however, these sidewalls 145*a*-145*d* are included only for simulation purposes, as described below with respect to FIG. 3. Accordingly, the branching microchannel manifolds 130 of the cooling apparatus 101 are fluidly coupled to one another and not separated by walls or structures. Similarly, the inlet manifolds 140 may be fluidly coupled together, and the outlet manifolds 142 may be fluidly coupled together.

The inlet manifold 140 is fluidly coupled to an impingement region 122 of the heat radiating surface 120*b*. Coolant fluid flows through the inlet manifold 140 as indicated by arrow 102, and then it impinges the heat radiating surface 120*b* at the impingement region 122. The inlet manifold 140 is fluidly coupled to the branching microchannel manifold 130, which comprises a plurality of fins 132 that extend from the heat radiating surface 120*b*. The plurality of fins 132 may be fabricated from any appropriate thermally conductive material by any appropriate process, such as, without limitation, micromachining, lithography, etching, and the like. In one embodiment, the plurality of fins 132 is integral with the heat radiating surface 120*b*. In the illustrated embodiment, the fins 132 orthogonally extend from the heat radiating surface 120*b*. However, in other embodiment, the fins 132 may extend from the heat radiating surface 120*b* at different angles.

The plurality of fins 132 define a plurality branching microchannels 133 within the branching microchannel manifold 130 that provide for a tortuous flow path for the coolant fluid after it impinges the heat radiating surface 120*b*. The plurality of fins 132 in the illustrated embodiment are configured as asymmetrical, wherein the individual fins 132 are non-uniform with respect to each other. The shape, number, and arrangement of fins 132 may be designed such that the branching microchannel manifold 130 has a lower pressure drop and a higher rate of heat transfer to the coolant fluid than provided by straight, uniform microchannels. For example, the width w decreases further away from the inlet manifold 140. The hierarchical nature of the branching microchannel widths may reduce the pressure drop across the inlet and outlet of the cooling apparatus, as well as provide for increased rates of heat transfer to the coolant fluid. Each of the branching microchannels 133 (and portion of branching microchannels) has a high aspect ratio defined by height h over width w. Accordingly, the height h of each branching microchannel 133 is greater than its width w.

Figure 3:
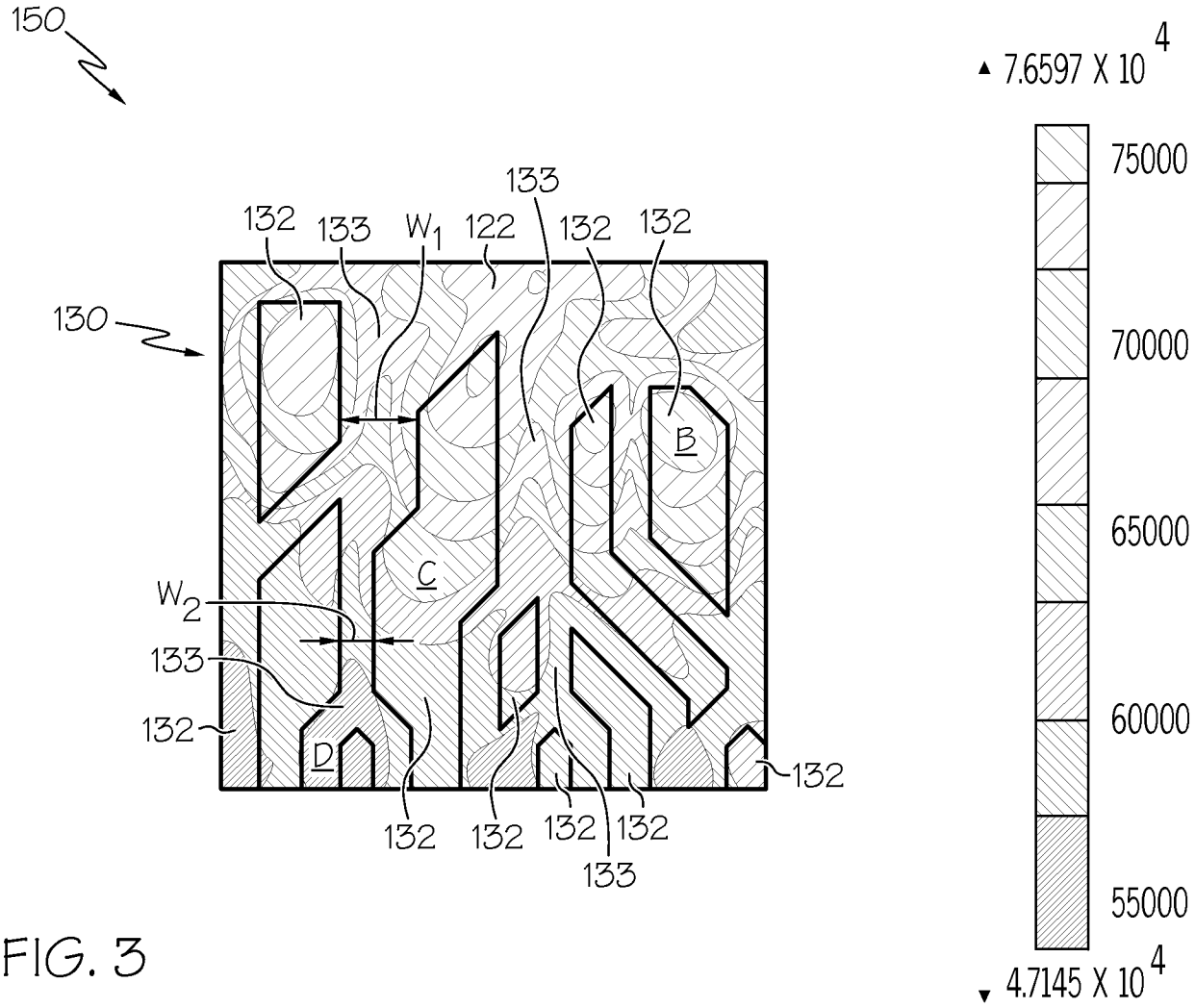
FIG. 3 graphically depicts the thermal transfer coefficients of the branching microchannel cell depicted in FIG. 2 by computer simulation, according to one or more embodiments described and illustrated herein.

It should be understood that embodiments are not limited to the plurality of fins 132 and the plurality of branching microchannels 133 that are depicted in FIGS. 1-3. The arrangement of the plurality of fins 132 and the plurality of branching microchannels 133 may depend on a variety of factors, such as a desired pressure drop, a desired heat transfer coefficient, the flow rate of coolant entering the cooling apparatus 101, and the like.

After impinging the impingement region 122 of the heat receiving surface 120, the coolant fluid flows parallel to the heat receiving surface 120 as indicated by arrow A through a tortuous flow path provided by the plurality of fins 132. The coolant fluid is then forced into changing its direction by about 90 degrees where it continues a tortuous flow path through the branching microchannels 133 normal to the heat receiving surface and out of the outlet manifold 142, as indicated by arrow 104. It is noted that the inlet manifold 140 and the outlet manifold 142 may further include fluid coupling components that are not depicted in FIG. 2, such as nozzles, fluid lines, and the like.

FIG. 3 depicts a heat transfer graph 150 that shows the heat transfer coefficients of the branching microchannel manifold 130 depicted in FIG. 2 (top view). The heat transfer graph 150 was generated by computer simulation, where the thermal transfer coefficient h was defined by: ((120,192 W/m$^2$)/(T−338.15)). It should be understood that embodiments may have other dimensions. The units of the scale of FIG. 2 are in W/(m$^2$*K). As an example and not a limitation, for the simulation the minimum microchannel width w was approximately 0.25 mm, and the fin height h was approximately 3 mm. The aspect ratio of the fins' height h to width w was approximately 12. As shown in FIG. 3, the greatest heat transfer occurs at the B region, while the C region and the D region each have lower heat transfer coefficients. The average heat transfer coefficient of the branching microchannel manifold 130 was about 61,600 W/(m$^2$*K), and the pressure drop across the inlet and the outlet was about 133 Pa.

The top view of the plurality of fins 132 and the plurality of branching microchannels 133 also depicts the hierarchical nature of the branching microchannel widths. For example, width $w_1$ that is closer to the impingement region 122 is wider than width $w_2$, which is further from the impingement region 122.

Figure 4A:
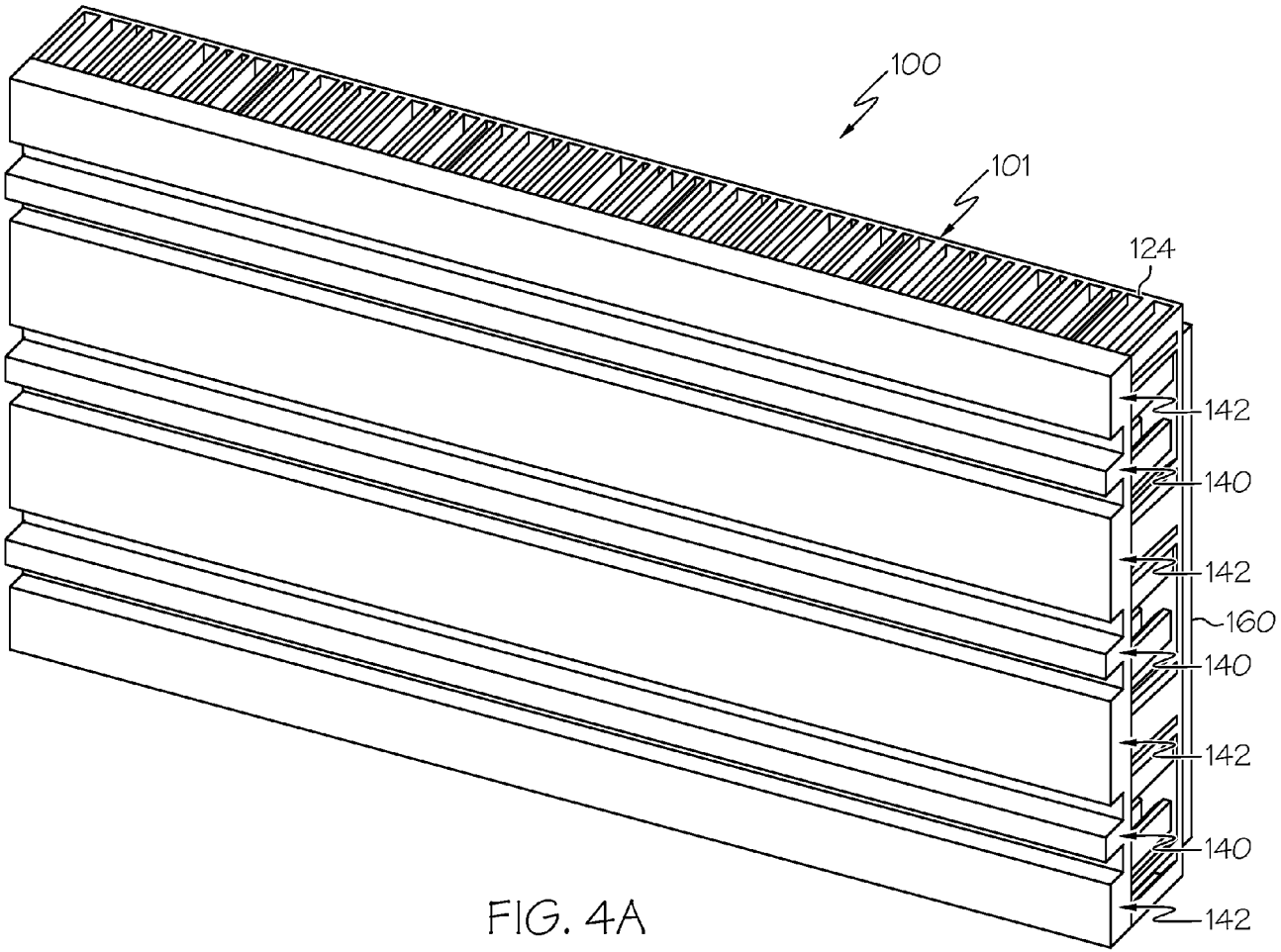
FIG. 4A schematically depicts a perspective view of the exemplary electronics module depicted in FIG. 1 with inlet manifolds and outlet manifolds, according to one or more embodiments described and illustrated herein.

Referring now to FIG. 4A, an electronics module 100 having exemplary inlet manifolds 140 and outlet manifolds 142 traversing the top face of the branching microchannel manifolds 130 of the array of branching microchannel cells 110 is schematically illustrated. The illustrated inlet manifolds 140 and outlet manifolds 142 are configured as depicted in FIG. 2. The inlet manifolds 140 and the outlet manifolds 142 are configured to introduce and remove coolant fluid to and from the branching manifolds 130 of the individual branching manifold cells 110, respectively. In one embodiment, the inlet manifolds 140 and the outlet manifold 142 comprise slot-shaped openings (now shown) through which coolant fluid may flow. In another embodiment, the inlet manifolds 140 and the outlet manifolds 142 comprise a plurality of discrete openings through which coolant fluid may flow. As the inlet manifolds 140 and the outlet manifolds 142 traverse along the width of the electronics module 100, inlets for adjacent branching microchannel cells 110 are fluidly coupled. Similarly, outlets for adjacent branching microchannel cells 110 are fluidly coupled together.

Figure 4B:
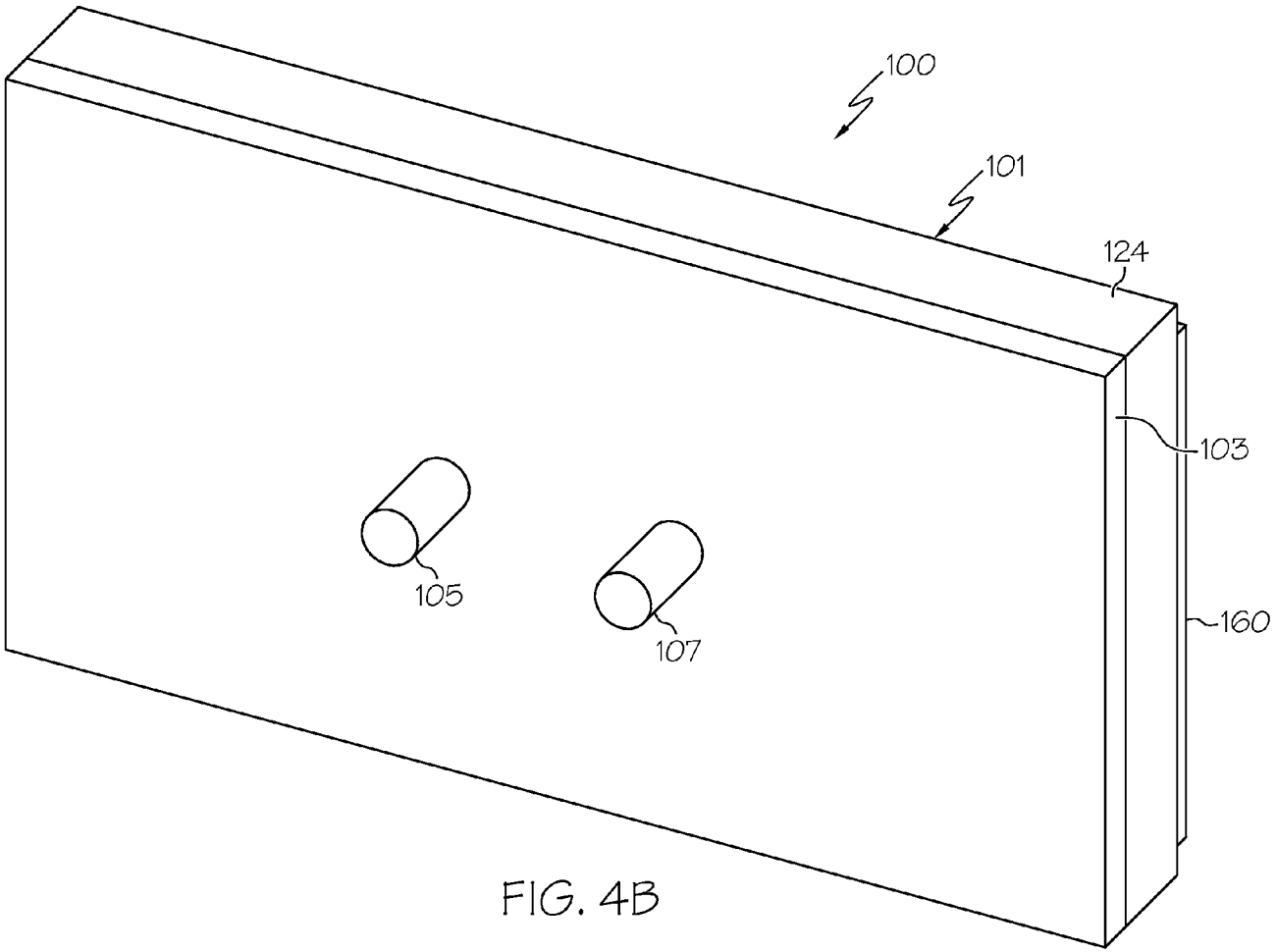
FIG. 4B schematically depicts a perspective view of an electronics module having an array of branching microchannel cells enclosed by a housing and a fluid distribution manifold, according to one or more embodiments described and illustrated herein.

Referring now to FIG. 4B, an electronics module 100 as depicted in FIG. 1 is schematically illustrated with a housing 124 and an exemplary fluid distribution manifold 103 that is fluidly coupled to the inlet manifolds 140 and the outlet manifolds 142 of the branching microchannel cells 110 (e.g., the inlet manifolds 140 and the outlet manifolds 142, as depicted in FIG. 4A). The fluid distribution manifold 103 has an inlet 107 for providing coolant fluid to the cooling apparatus 101, and an outlet 105 for removing warmed coolant fluid from the cooling apparatus 101. The inlet 105 may be fluidly coupled to the inlet manifolds 140, and the outlet 107 may be fluidly coupled to the outlet manifolds 142, to introduce and remove coolant fluid from the branching microchannel manifolds 130 of the array of branching microchannel cells 110 (see FIG. 1). Although not depicted in FIG. 4B, the inlet 105 and outlet 107 may be fluidly coupled to fluid lines that are coupled to a coolant fluid reservoir.

Figure 5:
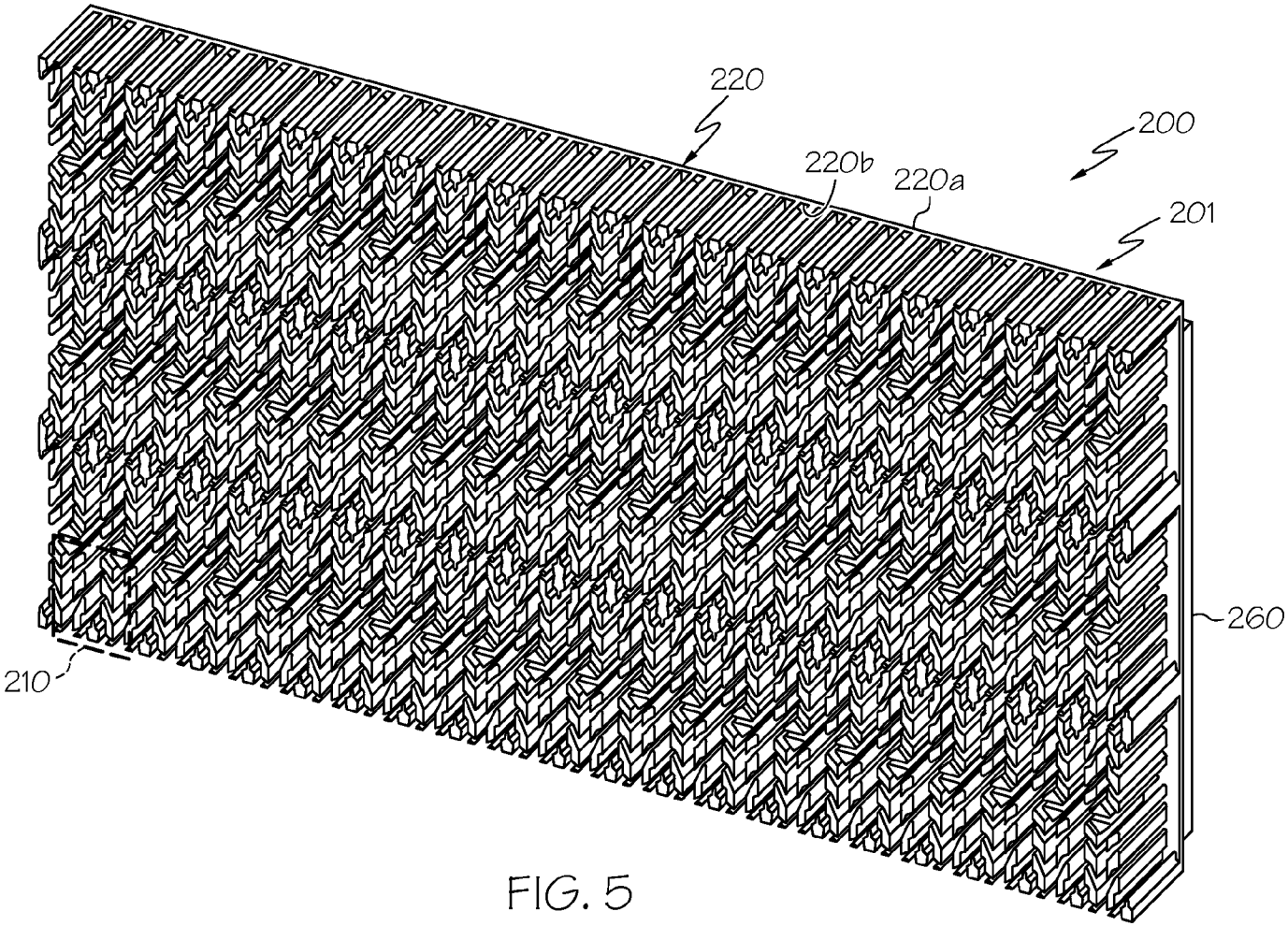
FIG. 5 schematically depicts a perspective view of another exemplary cooling apparatus having an array of branching microchannel cells, according to one or more embodiments described and illustrated herein.

FIG. 5 schematically depicts another exemplary electronics module 200 having a cooling apparatus 201 with the inlet and outlet manifolds removed. The cooling apparatus 201 includes a plate 220 including a heat receiving surface 220*a* and a heat radiating surface 220*b*. One or more heat generating devices 260 may be thermally coupled to the heat receiving surface 220*a*, as described above with respect to FIG. 1. The cooling apparatus 201 further includes an array of branching microchannel cells 210 extending from the heat radiating surface 220*b*. The plate 220 may be made of a thermally conductive material, such as, but not limited to, aluminum, copper, and thermally conductive polymers. The branching microchannel cells 210 may be arranged on the heat radiating surface 220*b* in a repeating pattern. It is noted that only one of the branching microchannel cells 210 are labeled and numbered in FIG. 5 for clarity of illustration. The illustrated cooling apparatus 201 includes a symmetrical array of individual branching microchannel cells 210. Coolant fluid may be introduced into the branching microchannel cells 210 through coolant inlets, where it impinges the heat radiating surface 220*b*, flows into the branching microchannels, and flows out of coolant outlets, as described above.

Figure 6:
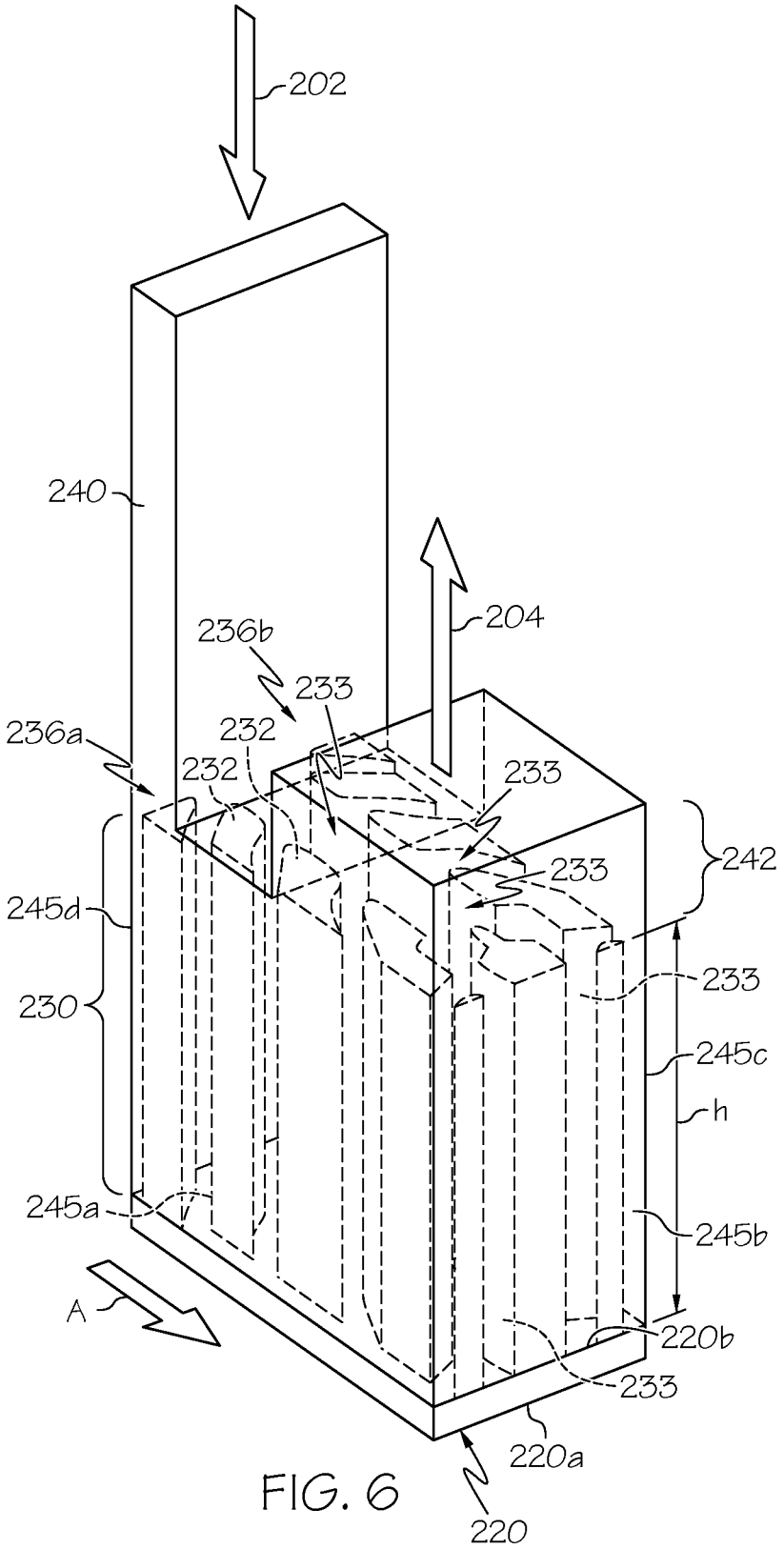
FIG. 6 schematically depicts a perspective view of an individual branching microchannel cell of the array of branching microchannel cells depicted in FIG. 5, according to one or more embodiments described and illustrated herein.

FIG. 6 depicts a branching microchannel cell 210 of the cooling apparatus 201 depicted in FIG. 5 in greater detail. The branching microchannel cell 210 is a 1/96th symmetry model of the cooling apparatus 201 depicted in FIG. 5. The branching microchannel cell 210 includes an inlet manifold 240, a branching microchannel manifold 230, and an outlet manifold 242 that is fluidly coupled to the branching microchannel manifold 230. It is noted that schematic depiction of the branching microchannel cell 210 includes sidewalls 245*a*-245*d*; however, these sidewalls 245*a*-245*d* are included only as boundaries for simulation purposes, as described below with respect to FIG. 7. Accordingly, the branching microchannel manifolds 230 of the cooling apparatus 200 are fluidly coupled to one another and not separated by walls or structures. Similarly, the inlet manifolds 240 may be fluidly coupled together, and the outlet manifolds 242 may be fluidly coupled together. The inlet manifolds 240 and the outlet manifolds 242 may traverse the top surface of the branching microchannel manifolds 230 of the array of microchannel cells 210, as described above with respect to the embodiment depicted in FIG. 4A.

The inlet manifold 240 is fluidly coupled to an impingement region 222 (see FIG. 7) of the heat radiating surface 220*b*. Coolant fluid flows through the inlet manifold 240 as indicated by arrow 202, and then it impinges the heat radiating surface 220*b* at the impingement region.

The inlet manifold 240 is fluidly coupled to the branching microchannel manifold 230, which comprises a plurality of fins 232 that extend from the heat radiating surface 220*b*. The plurality of fins 232 may be fabricated from any appropriate thermally conductive material by any appropriate process, such as, without limitation, lithography, etching, and the like. In one embodiment, the plurality of fins 232 is integral with the heat radiating surface 220*b*. In the illustrated embodiment, the fins 232 orthogonally extend from the heat radiating surface 220*b*. However, in other embodiment, the fins 232 may extend from the heat radiating surface 220*b* at different angles.

As described with respect to FIG. 2, the plurality of fins 232 define a plurality of branching microchannels 233 within the branching microchannel manifold 230 that provides for a tortuous flow path for the coolant fluid after it impinges the heat radiating surface 220*b*. The plurality of fins 232 in the embodiment illustrated in FIG. 2 is configured in a symmetrical arrangement, as opposed to the embodiment depicted in FIGS. 1-3. The plurality of fins 232 are arranged in a first half 236*a* and a second half 236*b*. The shape and arrangement of the fins 232 of the first half are symmetrical with respect to the shape and arrangement of the fins 232 of the second half. The shape, number, and arrangement of fins 232 may be designed such that the branching microchannel manifold 230 has a lower pressure drop and a higher rate of heat transfer to the coolant fluid than provided by straight, uniform microchannels.

After impinging the impingement region 222 (see FIG. 7) of the heat radiating surface 220*b*, the coolant fluid flows parallel to the heat radiating surface 220*b* as indicated by arrow A through a tortuous flow path provided by the plurality of fins 232. The coolant fluid is then forced into changing its direction by about 90 degrees where it continues a tortuous flow path through the branching microchannels 233 normal to the heat radiating surface 220*b* and out of the outlet manifold 242, as indicated by arrow 204. It is noted that the inlet manifold 240 and the outlet manifold 242 may further include fluid coupling components that are not depicted in FIG. 6, such as nozzles, fluid lines, and the like.

Figure 7:
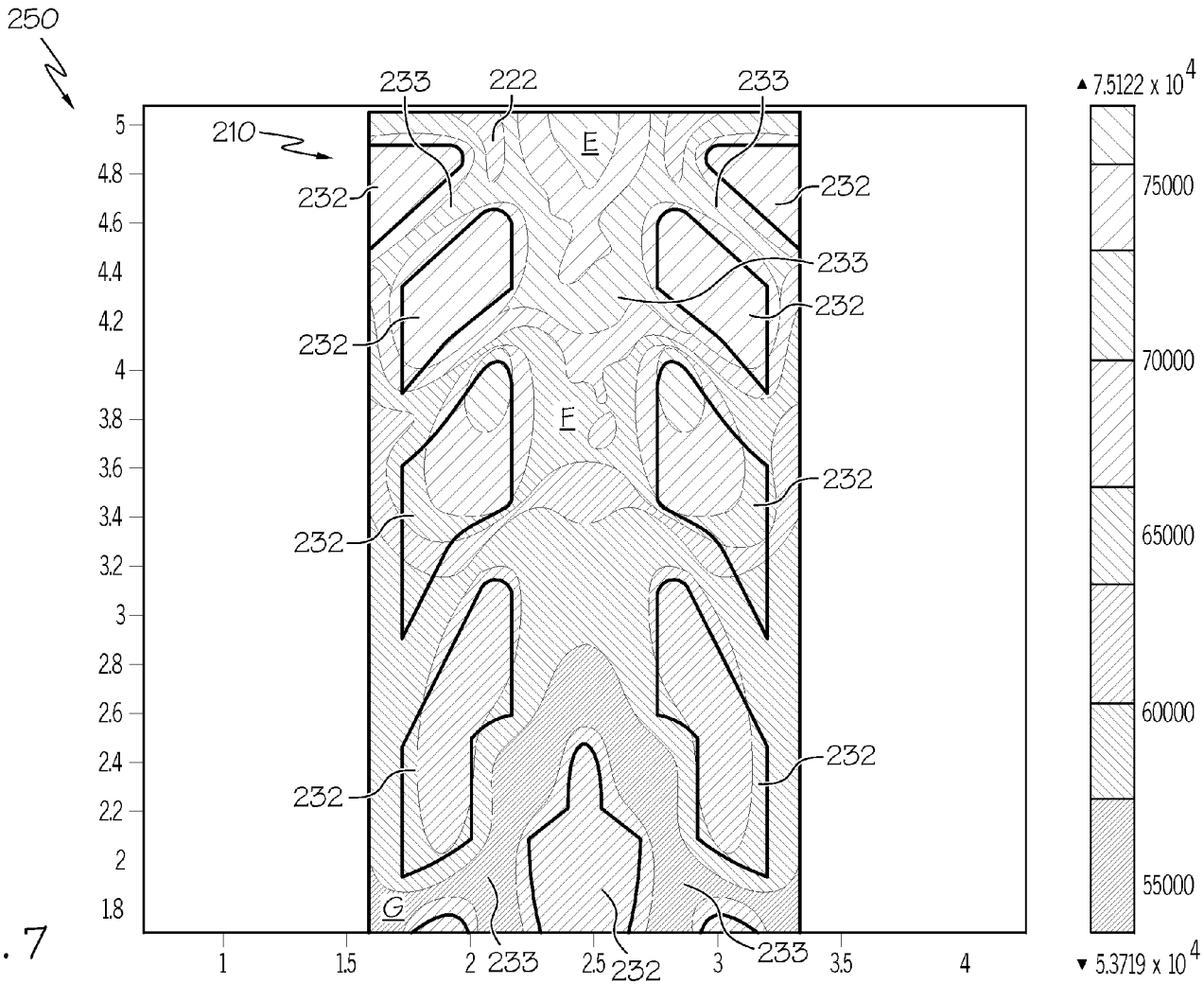
FIG. 7 graphically depicts the thermal transfer coefficients of the branching microchannel cell depicted in FIG. 6 by computer simulation, according to one or more embodiments described and illustrated herein.

FIG. 7 depicts a heat transfer graph 250 that shows the heat transfer coefficients of the branching microchannel manifold 230 depicted in FIG. 6 (top view). The heat transfer graph 250 was generated by computer simulation, where the thermal transfer coefficient h was defined by: $((120{,}192\ W/m^2)/(T-338.15))$. The units of the scale of FIG. 7 are in $W/(m^2*K)$. As shown in FIG. 7, the greatest heat transfer occurs at the E region, while the F region and the G region each have lower heat transfer coefficients. The average heat transfer coefficient of the branching microchannel manifold 230 was about 62,690 $W/(m^2*K)$, and the pressure drop across the inlet and the outlet was about 218 Pa.

Figure 8:
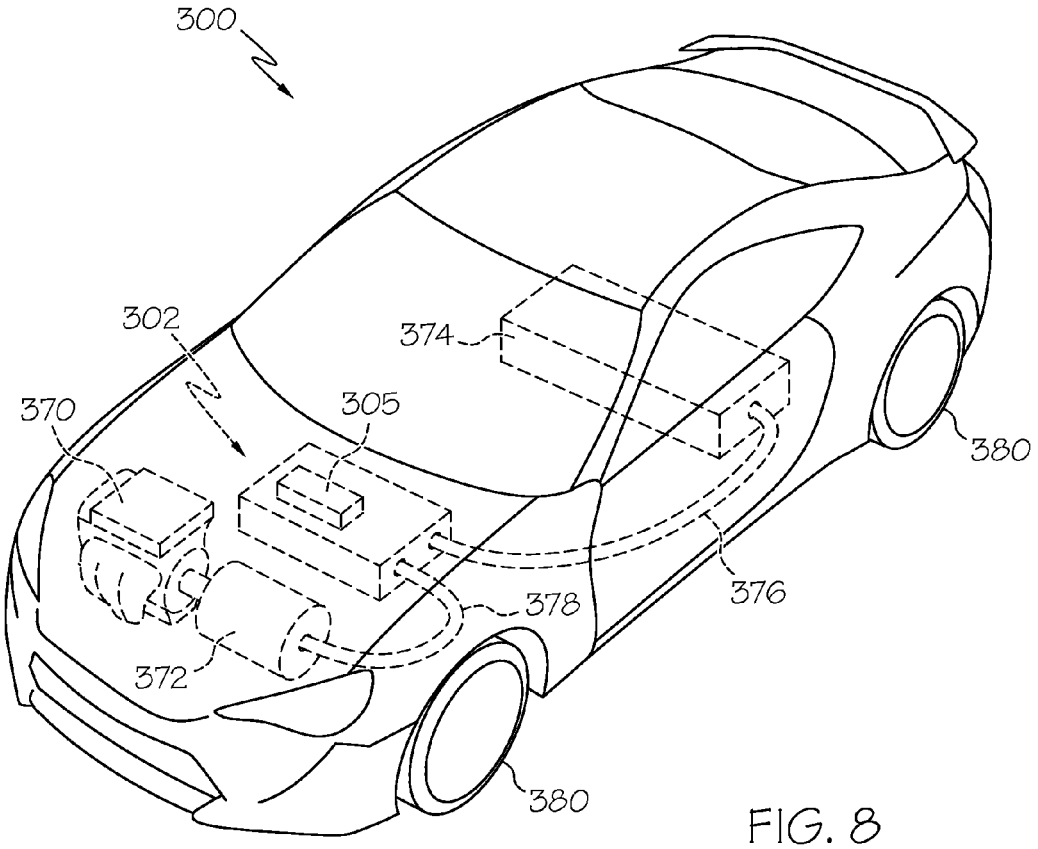
FIG. 8 schematically depicts a vehicle having an electric motor and a cooling apparatus including an array of branching microchannel cells, according to one or more embodiments described and illustrated herein.

As stated above, electronic modules having embodiments of the cooling apparatuses described herein may be incorporated into larger power circuits, such as inverter and/or converter circuits of an electrified vehicle. The electrified vehicle may be a hybrid vehicle, a plug-in electric hybrid vehicle, an electric vehicle, or any vehicle that utilizes an electric motor. Referring now to FIG. 8, a vehicle 300 configured as a hybrid vehicle or a plug-in hybrid vehicle is schematically illustrated. The vehicle generally comprises a gasoline engine 370 and an electric motor 372, both of which are configured to provide rotational movement to the wheels 380 of the vehicle 300 to propel the vehicle 300 down the road. A power circuit 302 is electrically coupled to electric motor 372 (e.g., by conductors 378). The power circuit 302 may be configured as an inverter and/or a converter circuit that provides electrical power to the electric motor 372. The power circuit 302 may in turn be electrically coupled to a power source, such as a battery pack 374 (e.g., by conductors 376). The power circuit 302 includes one or more electronics modules 305 (see FIG. 5) including one or more cooling apparatuses having branching microchannels, such as cooling apparatus 101 and cooling apparatus 201 described above.

It should now be understood that the embodiments described herein may be directed to cooling apparatuses and electronics modules having branching microchannels through which coolant fluid flows to remove heat flux from a heat generating device. The branching microchannels provide a tortuous flow path for coolant fluid after the coolant fluid impinges a heat radiating surface. The tortuous flow path, as well as the hierarchical nature of the microchannel widths, may reduce the pressure drop across an inlet and an outlet of the cooling apparatus and thereby increase thermal transfer of heat flux to the coolant fluid.

It should be understood that each of the branching microchannel cells described herein (including the branching microchannel cells 110, 110', 110", and 110''' shown and described with respect to FIGS. 1-2 and the branching microchannel cell 210 shown and described with respect to FIGS. 5-6) includes a portion of the plurality of fins that extend from the heat radiating surface in a specifically defined region of the cooling apparatus.

It should also be understood that FIG. 2 depicts a model of one of the branching microchannel cells of FIG. 1 with simulated sidewalls 145*a*, 145*b*, 145*c*, and 145*d* that are included only as boundaries for simulation purposes. However, the branching microchannel cells of the cooling apparatus 101 depicted in FIG. 1 do not include physical sidewalls that separate the branching microchannel cells from one another. Furthermore, because the branching microchannel cells of FIG. 1 do not include physical sidewalls, each branching microchannel cell of FIG. 1 does not include a separate inlet manifold. Instead, a common inlet manifold 140 spans multiple branching microchannel cells, as shown in FIG. 1 in conjunction with FIG. 4A. Likewise, because the branching microchannel cells of FIG. 1 do not include physical sidewalls, each branching microchannel cell of FIG. 1 does not include a separate outlet manifold. Instead, a common outlet manifold 142 spans multiple branching microchannel cells, as shown in FIG. 1 in conjunction with FIG. 4A.

It should also be understood that FIG. 6 depicts a model of one of the branching microchannel cells of FIG. 5 with simulated sidewalls 245*a*, 245*b*, 245*c*, and 245*d* that are included only as boundaries for simulation purposes. However, the branching microchannel cells of the cooling apparatus 201 depicted in FIG. 5 do not include physical sidewalls that separate the branching microchannel cells from one another. Furthermore, because the branching microchannel cells of FIG. 5 do not include physical sidewalls, each branching microchannel cell of FIG. 5 does not include a separate inlet manifold. Instead, a common inlet manifold spans multiple branching microchannel cells, in a manner similar to what is depicted in FIG. 4A. Likewise, because the branching microchannel cells of FIG. 5 do not include physical sidewalls, each branching microchannel cell of FIG. 5 does not include a separate outlet manifold. Instead, a common outlet manifold spans multiple branching microchannel cells, in a manner similar to what is depicted in FIG. 4A.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A cooling apparatus comprising:

a heat radiating surface;

an inlet manifold fluidly coupled to the heat radiating surface;

a branching microchannel manifold fluidly coupled to the inlet manifold, the branching microchannel manifold comprising a plurality of fins that orthogonally extend from the heat radiating surface, wherein the plurality of fins defines a plurality of branching microchannels that is normal with respect to the heat radiating surface, wherein the plurality of fins includes a first fin, a second fin, and a third fin, wherein the plurality of branching microchannels includes a first branching microchannel, wherein the first branching microchannel includes a first branch, a second branch fluidly coupled to the first branch, and a third branch fluidly coupled to the first branch, wherein the first branch is defined between the first fin and the second fin, the second branch is defined between the first fin and the third fin, and the third branch is defined between the second fin and the third fin; and an outlet manifold fluidly coupled to the plurality of branching microchannels.

2. The cooling apparatus of claim 1, wherein the inlet manifold is normal with respect to the heat radiating surface.

3. The cooling apparatus of claim 1, wherein the plurality of branching microchannels provide a tortuous flow path both parallel and normal to the heat radiating surface.

4. The cooling apparatus of claim 1, wherein the inlet manifold is fluidly coupled to the heat radiating surface at an impingement region such that coolant fluid impinges the heat radiating surface at the impingement region.

5. The cooling apparatus of claim 1, wherein individual fins of the plurality of fins are non-uniformly shaped.

6. The cooling apparatus of claim 1, wherein the plurality of fins comprises a first half of fins and a second half of fins, and a shape of the fins of the first half is symmetrical with respect to a shape of the fins of the second half.

7. An electronics module comprising:

a heat receiving surface;

a heat radiating surface;

a semiconductor device thermally coupled to the heat receiving surface;

an inlet manifold coupled to the heat radiating surface;

a branching microchannel manifold fluidly coupled to the inlet manifold, the branching microchannel manifold comprising a plurality of fins that orthogonally extend from the heat radiating surface, wherein the plurality of fins defines a plurality of branching microchannels that is normal with respect to the heat radiating surface, wherein the plurality of fins includes a first fin, a second fin, and a third fin, wherein the plurality of branching microchannels includes a first branching microchannel, wherein the first branching microchannel includes a first branch, a second branch fluidly coupled to the first branch, and a third branch fluidly coupled to the first branch, wherein the first branch is defined between the first fin and the second fin, the second branch is defined between the first fin and the third fin, and the third branch is defined between the second fin and the third fin; and an outlet manifold fluidly coupled to the plurality of branching microchannels.

8. The electronics module of claim 7, wherein the inlet manifold is normal with respect to the heat radiating surface.

9. The electronics module of claim 7, wherein the plurality of branching microchannels provide a tortuous flow path both parallel and normal to the heat radiating surface.

10. The electronics module of claim 7, wherein the inlet manifold is fluidly coupled to the heat radiating surface at an impingement region such that coolant fluid impinges the heat radiating surface at the impingement region.

11. The electronics module of claim 7, wherein individual fins of the plurality of fins are non-uniformly shaped.

12. The electronics module of claim 7, wherein the plurality of fins comprises a first half of fins and a second half of fins, and a shape of the fins of the first half is symmetrical with respect to a shape of the fins of the second half.

13. A vehicle comprising:

an electric motor; and an electronics module electrically coupled to the electric motor, the electronics module comprising:

a heat receiving surface;

a heat radiating surface;

a semiconductor device thermally coupled to the heat receiving surface;

an inlet manifold coupled to the heat radiating surface;

a branching microchannel manifold fluidly coupled to the inlet manifold, the branching microchannel manifold comprising a plurality of fins that orthogonally extend from the heat radiating surface, wherein the plurality of fins defines a plurality of branching microchannels that is normal with respect to the heat radiating surface, wherein the plurality of fins includes a first fin, a second fin, and a third fin, wherein the plurality of branching microchannels includes a first branching microchannel, wherein the first branching microchannel includes a first branch, a second branch fluidly coupled to the first branch, and a third branch fluidly coupled to the first branch, wherein the first branch is defined between the first fin and the second fin, the second branch is defined between the first fin and the third fin, and the third branch is defined between the second fin and the third fin; and an outlet manifold fluidly coupled to the plurality of branching microchannels.

14. The vehicle of claim 13, wherein the inlet manifold is fluidly coupled to the heat radiating surface at an impingement region such that coolant fluid impinges the heat radiating surface at the impingement region.

15. The vehicle of claim 13, wherein individual fins of the plurality of fins are non-uniformly shaped.

16. The vehicle of claim 13, wherein the plurality of fins comprises a first half of fins and a second half of fins, and a shape of the fins of the first half is symmetrical with respect to a shape of the fins of the second half.

17. The cooling apparatus of claim 4, wherein a first width of the first branching microchannel at a first location is wider than a second width of the first branching microchannel at a second location, wherein the first location is closer to the impingement region than the second location.

* * * * *